US006302760B1

(12) United States Patent
Dai

(10) Patent No.: US 6,302,760 B1
(45) Date of Patent: Oct. 16, 2001

(54) AIR BAG TYPE BRASSIERE

(75) Inventor: Fu Ming Dai, 1F, No. 79-9, Tung Lai Rd., Hemei Jen, Chang Hua Hsien (TW)

(73) Assignees: Fu Ming Dai, Chang Hua Hsien; Yung Sheng Wang, Chang Hua, both of (TW)

( * ) Notice: Subject to any disclaimer, the term of this patent is extended or adjusted under 35 U.S.C. 154(b) by 0 days.

(21) Appl. No.: 09/637,355

(22) Filed: Aug. 15, 2000

(51) Int. Cl.[7] ..... A41C 3/00
(52) U.S. Cl. ..... 450/38; 450/57
(58) Field of Search ..... 2/67, 61, 267–268; 450/38, 39, 55–57, 30, 88, 1

(56) References Cited

U.S. PATENT DOCUMENTS 5,347,656 * 9/1994 Fabritz et al. ..... 2/67
6,058,507 * 5/2000 Klimenko ..... 2/67
6,080,037 * 6/2000 Lee et al. ..... 450/38

* cited by examiner

*Primary Examiner*—Gloria M. Hale
(74) *Attorney, Agent, or Firm*—Rosenberg, Klein & Lee

(57) ABSTRACT

The present invention proposes an air bag type brassiere, which uses a small air intake pump operated by pressing to draw external air into air bags imbedded therein so that the user can exactly adjust the air bags to the required size. Moreover, the air bags can be deflated for adjustment or storage by pressing the air relief valve on the air bags. Additionally, a number of exhaust holes are arranged at the places fused by high-frequency wave at the edges of the air bags to radiate heat generated by human body. Thereby, the user will not feel hot and moist.

4 Claims, 5 Drawing Sheets

AIR BAG TYPE BRASSIERE

BACKGROUND OF THE INVENTION

1. Field of the Invention

The present invention relates to an air bag type brassiere and, more particularly, to a brassiere which uses a small air intake pump operated by pressing to draw air into air bags imbedded in the brassiere so that the user can exactly adjust the air bags to the required size.

2. Prior Art

In an air bag type brassiere of the prior art, shown in FIG. 1, air bags A are imbedded in two cups B1 of a brassiere B. An inflation opening A1 is arranged at one side of each of the air bags A. When it is necessary to blow in air, a blow pipe A2 is first inserted in the inflation opening A1 of each of the air bags A, and air is then blown into the air bags A in the same way air is blown into a balloon until the air bags A gradually expand to the required size.

Because air is blown into the air bags A by the user, the quantity of blown-in air will not be equal each time, so the two cups B1 of the brassiere B will not be the same size. Much time is needed for adjustment. Moreover, because it is necessary to place the blow pipe A2 into the user's mouth for flowing in air, such results in inconvenience and inelegance.

Therefore, the method of inflation of the air bags in the prior art air bag type brassiere is very inconvenient and time consuming. Moreover, it is very inelegant to adjust the brassiere in public places extemporaneously. Private and fast adjustment can not be achieved.

To sum up, the prior art air type brassiere has the following drawbacks.

1. The quantity of inflation air will not be equal each time so that the two cups of the brassiere will not be equal in size. Much time will then be wasted for adjustment.
2. When it is necessary to adjust the brassiere in a public place, a blow pipe is first inserted therein and then placed in the mouth for blowing air into the air bag. Much inconvenience and inelegance results.
3. Because the air blown into the air bag contains hot and moist air, the air bags will exude heat and moisture, so that the user will feel uncomfortable.
4. After being inflated many times, the air bags will accumulate saliva blown out from the user's mouth. Constant cleaning is required, resulting in time consuming and inconvenient use.

Therefore, the structure of the prior art air bag type brassiere needs to be improved to overcome the above drawbacks.

SUMMARY AND OBJECTS OF THE PRESENT INVENTION

The primary object of the present invention is to provide an air bag type brassiere, which uses a small air intake pump operated by pressing to draw air into air bags imbedded therein so that the user can adjust the air bags to exactly the desired size.

Another object of the present invention is to provide an air bag typ brassiere, wherein air bags can be deflated for adjustment or storage by pressing an air relief valve arranged at one end of each of the air bags.

Yet another object of the present invention is to provide an air bag type brassiere, wherein a number of ventilation holes can be arranged at locations fused by high-frequency energy at the edges of the air bags, to radiate heat generated by the human body. Thereby, the user will not feel hot and moist.

The various objects and advantages of the present invention will be more readily understood from the following detailed description when read in conjunction with the appended drawings, in which:

DETAILED DESCRIPTION OF PREFERRED EMBODIMENT

Figure 1:
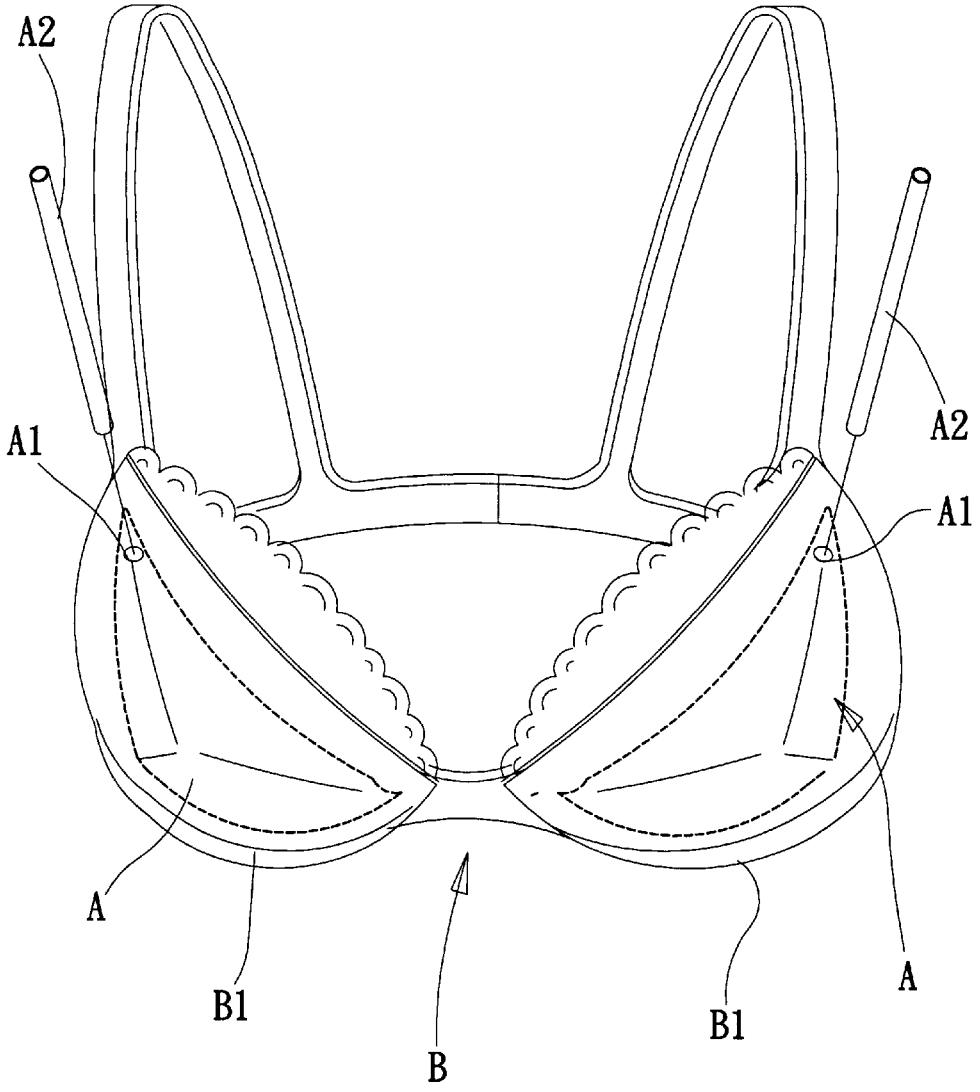
FIG. 1 PRIOR ART
FIG. 1 is a perspective view of a prior art ai bag type brassiere.
Figure 2:
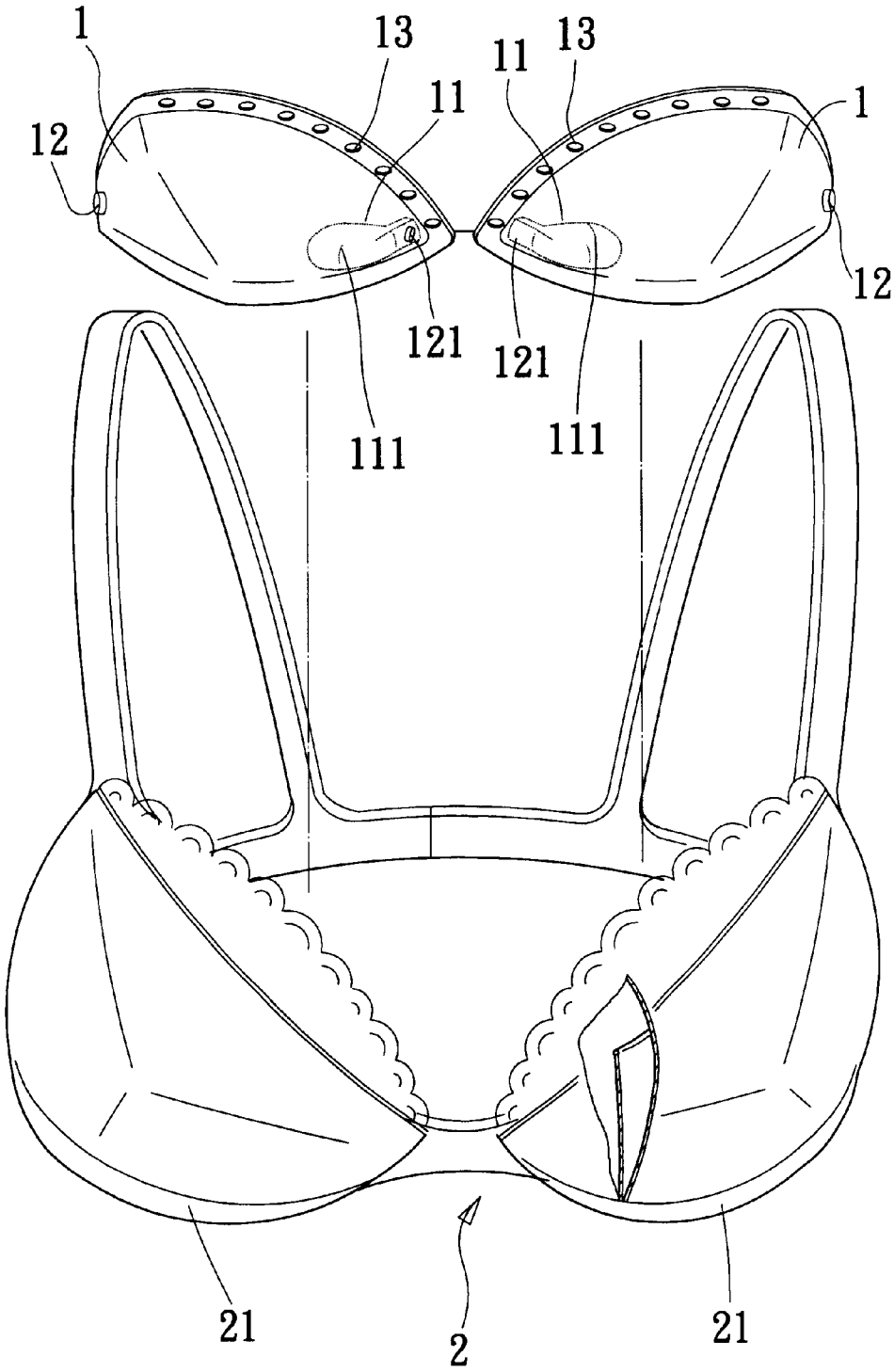
FIG. 2 is an exploded perspective view of an air bag type brassiere of the present invention.
Figure 3:
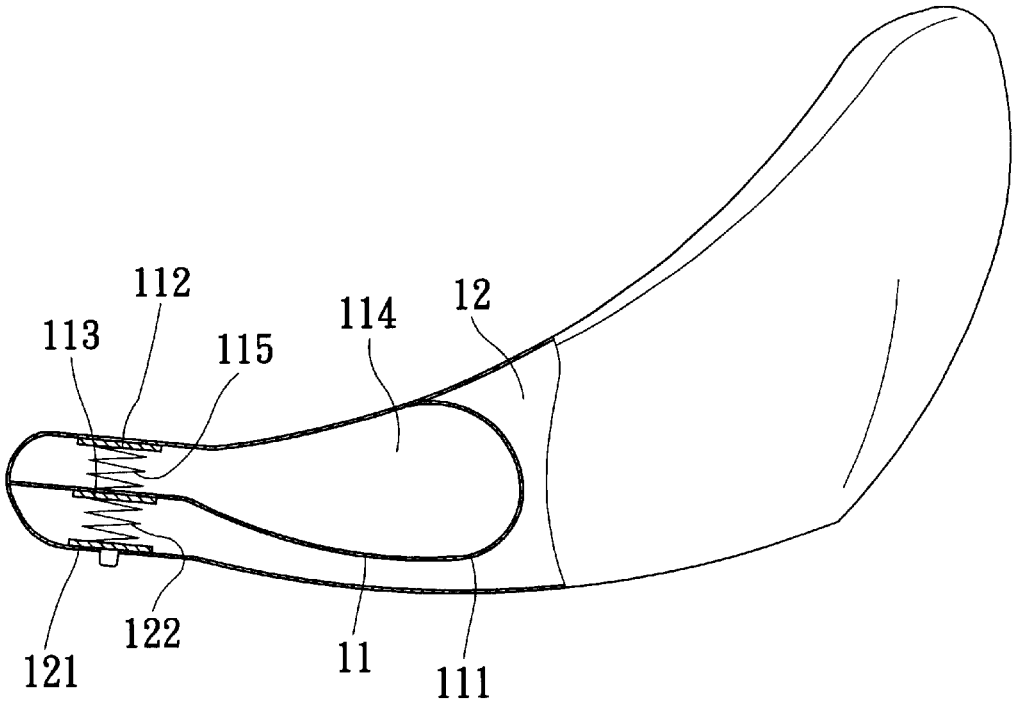
FIG. 3 is an internal cross-sectional top view of an air bag type brassiere of the present invention.
Figure 4A:
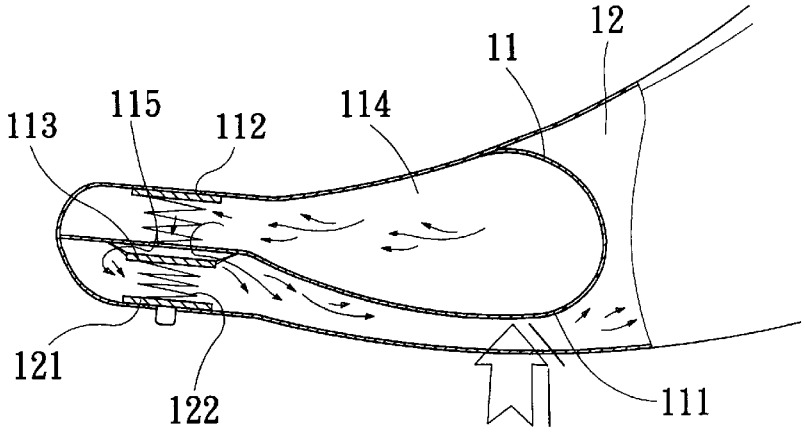
FIG. 4A is an internal top view showing the action of an air bag type brassiere of the present invention.
Figure 4B:
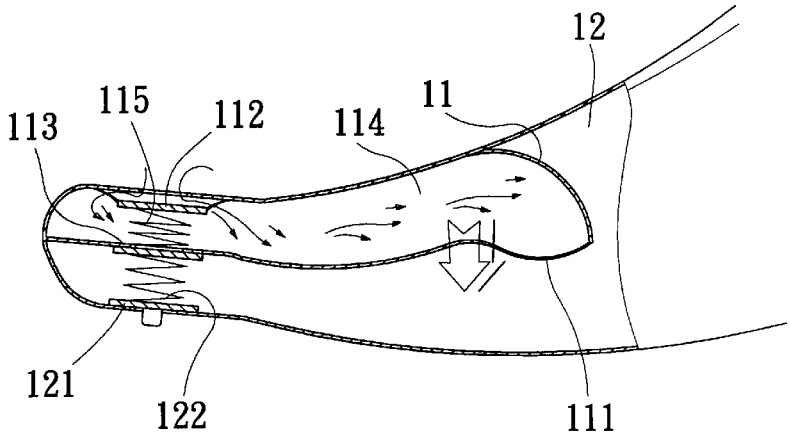
FIG. 4B is another internal top view showing the action of an air bag type brassiere of the present invention.
Figure 4C:
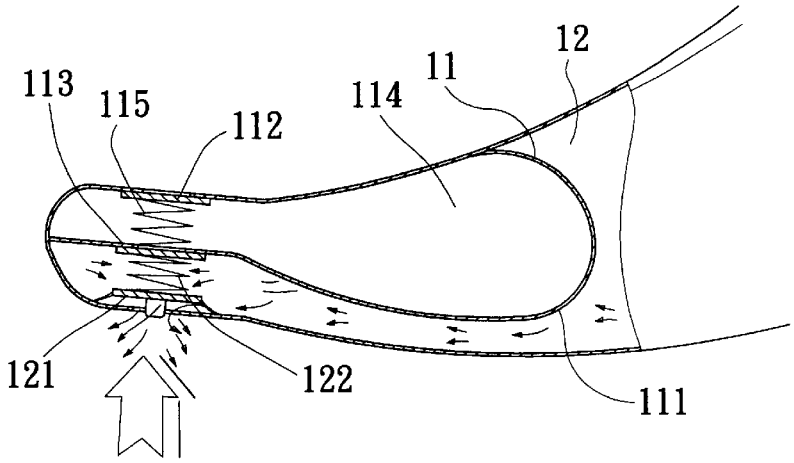
FIG. 4C is yet another internal top view showing the action of an air bag type brassiere of the present invention.

As shown in FIGS. 2, 3, 4A, 4B, and 4C, the present invention provides an air bag type brassiere, wherein two dissymmetrical air bags 1 are embedded in two cups 21 of a brassiere 2. The air bag 1 comprises a large air-collecting room 12 and a blast pump 11. An air relief valve 121 is installed at the internal front end of the large air-collecting room 12. The air relief valve 121 is internally connected to a first resilient element 122. The first resilient element 122 can be a spring. The volume of the blast pump 11 is slightly smaller than that of the large air-collecting room 12 and is fixedly installed at the internal rear end thereof. The blast pump 11 is a small air-collecting room 114 with a press part 111, an air intake valve 112, a blast valve 112, a blast valve 113, and a second resilient element 115 installed thereon. The second resilient element 115 can be a spring. The press part 111 is installed at the outer side of the blast pump 11. The air intake valve 112 is installed at the internal rear part of the blast pump 11. The blast valve 113 is installed at the internal front end of the blast pump 11 and is connected to the first resilient element 122. The second resilient element 115 is connected to the air intake valve 112 and the blast valve 113.

When the user presses the press part 111 on the blast pump 11, the blast valve 113 will push forwards to let the air in the blast pump 11 be transferred to the large air-collecting room 12. Next, the blast valve 113 will restore to its original position to close the opening due to the resiliency of the first resilient element 112. When the press part 111 is released, the air intake valve 112 will push forwards to let some ambient air, external to the blast pump 11, be stored in the blast pump 11, and then close the opening. Continually pressing the press part 111 will let the large air-collecting room 12 be inflated gradually until the cups 21 sheathed outsides are inflated to saturation. On the other hand, when the user pushes the air relief valve 121 backwards lightly, the large air-collecting room 12 will gradually discharge the air therein and be deflated so that the cups 21 will also be deflated. When the air relief valve 121 is released, it will restore to its original position to close the opening due to the resiliency of the first resilient element 122. Thereby, the size of the brassiere 2 can be adjusted.

Additionally, a number of ventilation holes 13 can be arranged at locations fused by high-frequency energy at the edges of the air bags 1 to radiate heat generated by the user's body. Thereby, the user will not feel hot and moist.

Figure 5:
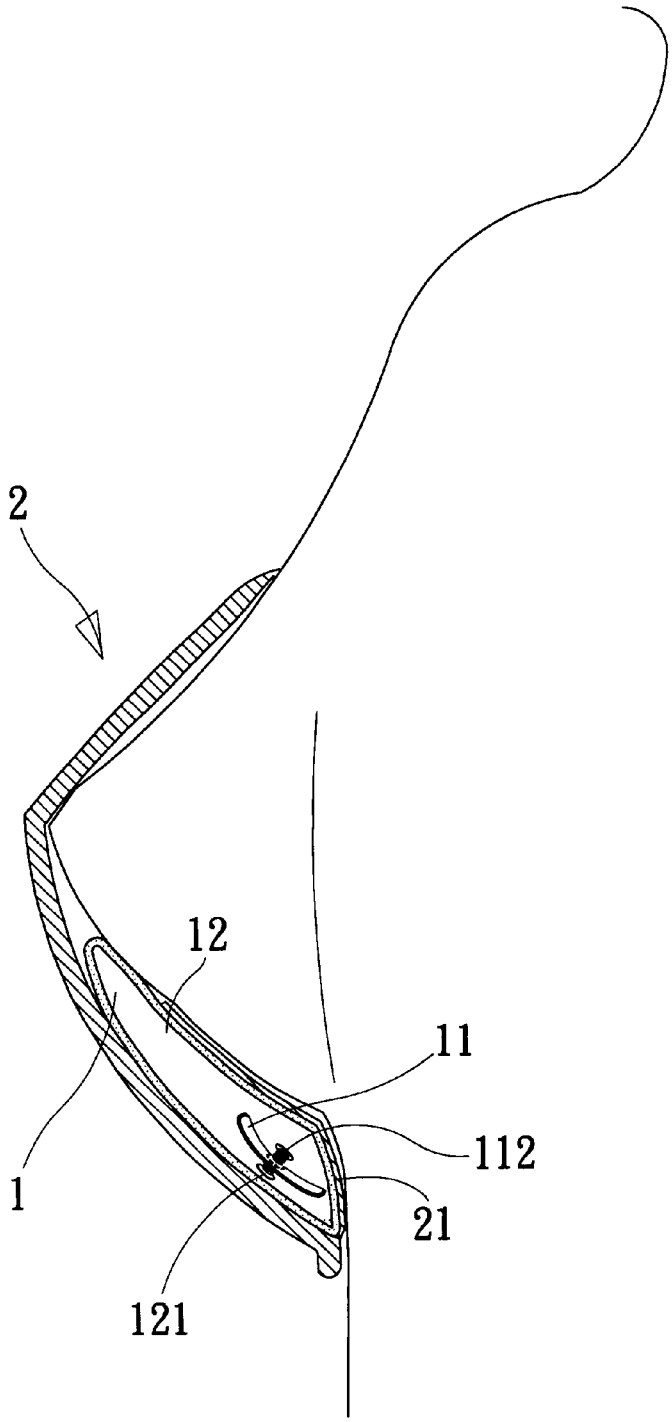
FIG. 5 is a cross-sectional side view of an air bag type brassiere according to an embodiment of the present invention.

As shown in FIG. 5, the present invention can uplift the breasts of a woman wearing the brassiere 2 to show her fullness.

As is described above, the inflation method of the present invention is very convenient and easy. Only pressing the pres parts at the inner sides of the breasts is required to extemporaneously adjust the brassiere in a public place. Private, fast, and efficient adjustment of the brassiere can thus be achieved.

To sum up, the present invention has the following advantages.

1. Because the size of each air-collecting room is equal, the quantity of inflation air pumped each time is also equal. Therefore, the two cups of the brassiere will be of the same size. Time will not be wasted for adjustment of the brassiere.
2. Only the press parts need to be pressed when the user needs to adjust the brassiere in a public place. Therefore, inconvenience and inelegance does not arise.
3. Because the inflation air is ambient air, the user will not feel uncomfortable.
4. Because the inflation air is ambient air, the air bags will not accumulate spittle from the user's mouth. Therefore, cleaning and maintenance will be very convenient.

The present invention provides an air type brassiere, which uses a small air intake pump operated by pressing to draw ambient air external to the air intake pump, into air bags imbedded in the brassiere, so that the user can adjust the air bags to exactly the desired size. Moreover, the air bags can be deflated for adjustment or storage by pressing the air relief valves on the air bags. Additionally, a number of ventilation holes are arranged at locations fused by high-frequency energy at the edges of the air bags, to radiate heat generated by the user's body. Thereby, the user will not feel hot and moist.

Although the present invention has been described with reference to the preferred embodiments thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An air bag type brassiere comprising two dissymmetrical air bags embedded in two cups thereof, each of said air bags comprising:

a large air-collecting room with an air relief valve installed at an internal front end thereof, said air relief valve being internally connected to a first resilient element; and a blast pump having a volume slightly smaller than that of said large air-collecting room, the blast pump being fixedly installed in said large air-collecting room, said blast pump being a small air-collecting room having a press part, an air intake valve, a blast valve, and a second resilient element installed thereon, said press part being installed at an outer side of said blast pump, said air intake valve being installed at an internal rear part of said blast pump, said blast valve being installed at an internal front end of said blast pump and being connected to said first resilient element, said second resilient element being connected to said air intake valve and said blast valve;

whereby when said press part is pressed, the air in said blast pump will be transferred to said large air-collecting room, and when said press part is released, ambient air external to said blast pump will be transferred and stored in said blast pump for inflation of said cups; when said air relief valve is pushed to discharge air, said air bags will be deflated and said cups therewith; thereby, adjusting a size of said brassiere.

2. The air bag type brassiere as claimed in claim 1, wherein a number of ventilation holes are arranged at locations fused by high-frequency energy at respective edges of said air bags to radiate heat generated by a user's body.

3. The air bag type brassiere as claimed in claim 1, wherein said blast pump is installed at an internal rear end of said large air-collecting room.

4. The air bag type brassiere as claimed in claim 1, wherein said first and second resilient elements are springs.

* * * * *